United States Patent [19]

Ito et al.

[11] Patent Number: 4,943,810

[45] Date of Patent: Jul. 24, 1990

[54] ANTENNA COIL WITH INTEGRAL HOUSING

[75] Inventors: Katsuo Ito; Eiichi Hibino; Masahiro Nishimura; Kazunori Kinoshita; Shigeki Takase, all of Nagaokakyo, Japan

[73] Assignee: Murata Manufacturing Co., Ltd., Kyoto, Japan

[21] Appl. No.: 358,524

[22] Filed: May 30, 1989

Related U.S. Application Data

[63] Continuation of Ser. No. 240,615, Sep. 6, 1988, abandoned.

[51] Int. Cl.[5] ..... H01Q 1/24

[52] U.S. Cl. ..... 343/702; 343/867; 343/872

[58] Field of Search ..... 343/702, 742, 867, 872, 343/873; 361/422, 429; 174/66, 65 R, 59, 62

[56] References Cited

U.S. PATENT DOCUMENTS

| | | | |
|---|---|---|---|
| 3,965,474 | 6/1976 | Guerrino | 343/872 |
| 4,278,980 | 7/1981 | Ogita et al. | 343/867 |
| 4,334,227 | 6/1982 | Marks | 343/867 |
| 4,757,321 | 7/1988 | Matsuta et al. | 343/872 |

*Primary Examiner*—Rolf Hille
*Assistant Examiner*—Peter Toby Brown
*Attorney, Agent, or Firm*—Wenderoth, Lind & Ponack

[57] ABSTRACT

An antenna device used for a UHF tuner or the like, which comprises a combination of an antenna coil formed of single-covered wire with an insulator covering the antenna coil. The insulator is dividedly molded into a coil containing member having an antenna coil containing recess and a terminal member having a pair of antenna terminals and a resistor containing recess, a fitting portion to be fitted between the coil containing member and the terminal member is provided, and at the terminal member a cover for closing an opening at the coil containing recess. The coil containing member containing the antenna coil in the coil containing recess and the terminal member containing a resistor in the resistor containing recess are integrally connected by press-fitting of the fitting portion and the antenna coil is housed in the insulator, thereby obtaining the insulating property equivalent to a double covered wire without deforming the the coil during or after the assembly of the antenna device.

4 Claims, 3 Drawing Sheets

FIG.5
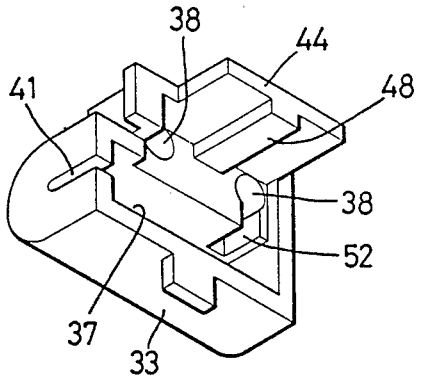
FIG.6
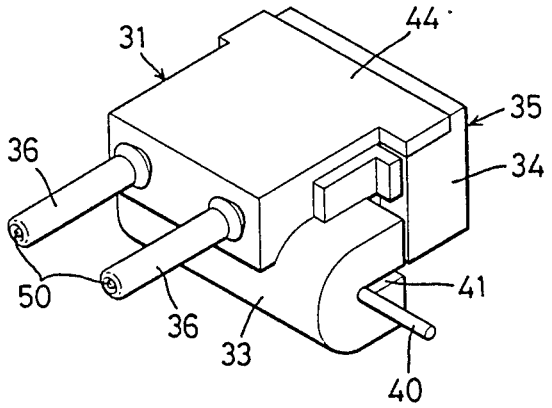
FIG.7
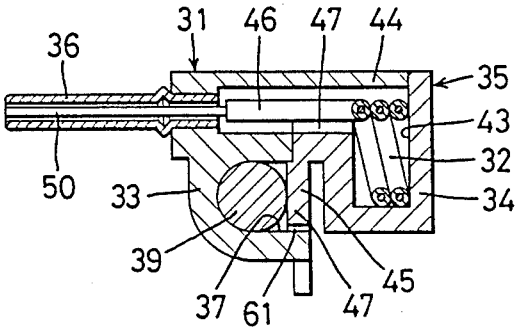
FIG.8
FIG.9
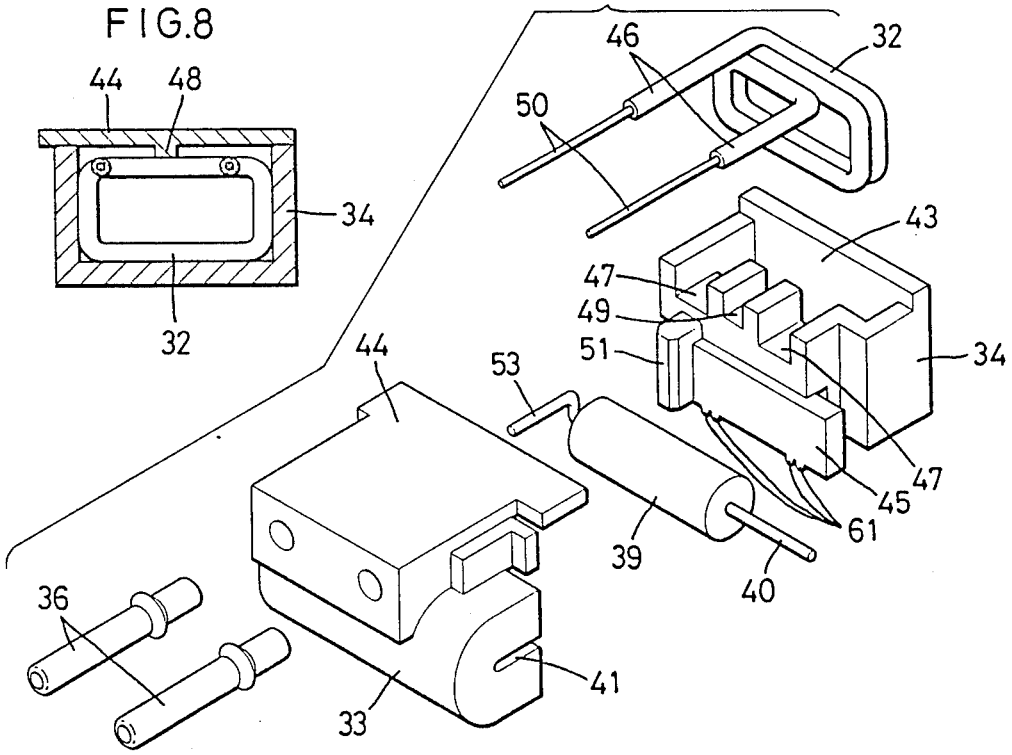

ANTENNA COIL WITH INTEGRAL HOUSING

This application is a continuation of now abandoned application Ser. No. 240,615, filed on Sept. 6, 1988.

FIELD OF THE INVENTION

The present invention relates to an antenna device, and more particularly to an antenna device introducing an antenna output into a UHF tuner of a television receiver.

BACKGROUND OF THE INVENTION

The conventional antenna device for the UHF tuner, from the view point of UL safety standard, must use a double covered wire or a wire of single coating larger in thickness, for example, of 0.028 in. (0.71 mm) or more.

FIGS. 12 through 14 are structural views of the conventional antenna device.

In the same drawing, an antenna device 21 comprises an antenna coil 22 of double covered wire, a terminal member 23 and a coil holding frame 24 formed of insulating material, the terminal member 23 fixing at the front thereof a pair of hollow antenna terminals 25.

At the rear of the terminal member 23 are formed a pair of bores 26 communicating with the rear portions of the antenna terminals 25 respectively and a recess 27 into which a resistor 28 is mounted.

The coil holding frame 24 holds the antenna coil 22 and is attached to the rear surface of the terminal member 23 at both sides of the recess 27 and the antenna coil 22 is inserted at both ends into the bores 26 respectively.

Both the ends of antenna coil 22, from which front coating is peeled off to expose internal conductor wires, are inserted into the antenna terminals 25 and the utmost ends of conductor wires are soldered to the utmost ends of antenna terminals 25 respectively.

The above-mentioned conventional antenna device 21, whose coil 22 is larger in thickness at the insulating material part, is larger in wire diameter, hard to work, poor in workability, and expensive to produce.

Also, variations in molding are often created to give an adverse effect to the electrical characteristics (especially, an input voltage standing wave ratio).

OBJECTS OF THE INVENTION

A first object of the invention is to provide an antenna device which can obtain with ease an antenna coil of accurate configuration, has no fear that the antenna coil is deformed during or after assembly, and is obtainable of insulating property equivalent to the double covered wire.

A second object of the present invention is to provide an antenna device easy to assemble, of low material cost, and reduced in an assembly time.

These and other objects of the invention will become more apparent in the detailed escription and examples which follow:

BRIEF DESCRIPTION OF THE DRAWINGS

FIG. 5 is a perspective view of the rear of a terminal member at the same, FIG. 6 is a perspective view of a second embodiment of an antenna device of the invention, FIG. 7 is a longitudinally sectional side view thereof, FIG. 8 is a longitudinally sectional front view of the same, FIG. 9 is a perspective exploded view of the same.

DETAILED DESCRIPTION OF THE INVENTION

Figure 1:
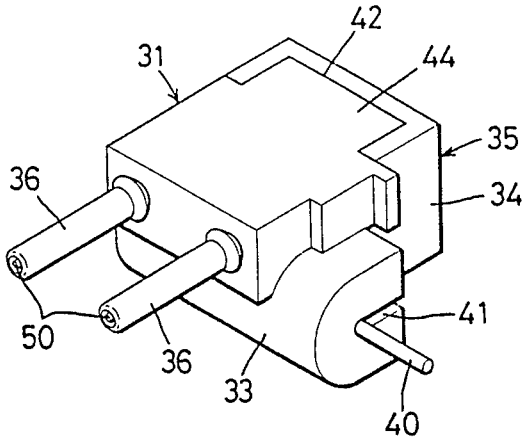
FIG. 1 is a perspective view of a first embodiment of an antenna device of the invention.
Figure 3:
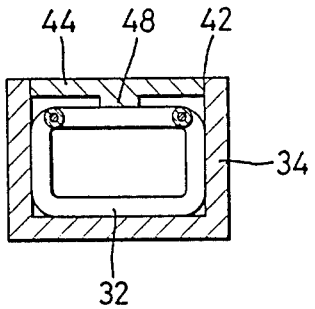
FIG. 3 is a longitudinally sectional front view of the same.

In a first embodiment of an antenna device of the invention shown in FIGS. 1 through 5, an antenna device 31 comprises an antenna coil 32 of single-covered wire smaller in wire diameter and easy to work and an insulator 35 comprising a terminal member 33 formed of insulating material, such as synthetic resin, and a coil containing member 34 formed of the insulating material.

The terminal member 33 is provided at the front with a pair of left and right antenna terminals 36 each hollow and projecting, and at the lower portion with a resistor containing recess 37 rearwardly open, so that a pair of bores 38 communicating with the rear ends of the antenna terminals 36 are provided at both sides of the upper portion of the containing recess 37, and at one side surface thereof is provided a groove 41 through which a lead wire 40 of a resistor 39 mounted to the containing recess 37 is a led out to the exterior.

The terminal member 33 and coil containing member 34 are provided with a mutually fitting portion 42 which is press-fitted therebetween to integrally couple the terminal member 33 with the coil containing member 34.

The fitting portion 42 in the first embodiment comprises a coil containing recess 43 provided at the coil containing member 34 and open upwardly thereof and a cover 44 integral with the rear portion of terminal member 33 so as to be tightly fitted into the inner periphery of the upper opening of the coil containing recess 43.

Furthermore, in front of the coil containing member 34 is integrally formed a lid 45 to be fitted into a resistor containing recess 37 at the terminal member 33. In front of the coil containing recess 43 are formed a pair of grooves 47 into which both ends 46 of the antenna coil 32 are fitted and a groove 49 into which a projection 48 projecting from the lower surface of the cover 44 is fitted.

The antenna device 31 at the first embodiment is assembled in such a manner that that the antenna coil 32 is contained in the coil containing recess 43 at the coil containing member 34, both the ends 46 of the antenna coil 32 project forwardly and are fitted into the grooves 47 respectively portions of the antenna coil 32 projecting enough from the grooves 47 are peeled off at the coatings respectively so as to expose internal conductor wires 50, and the conductor wires 50 are inserted into the antenna terminals 36 and soldered thereto, thereby electrically and mechanically connecting the conductor wires 50 with the terminal member 33.

The resistor 39 is previously contained in the resistor containing recess 37 at the terminal member 33, the cover 44 at the terminal member 33 is press-fitted into the upper opening of coil containing recess 43 at the coil containing member 34, the lid 45 therefor is fitted into the resistor containing recess 37 at the terminal member 33, and a projection 51 provided at one lengthwise end of the lid 45 is fitted into a groove 52 at the terminal member 33, thereby integrally coupling the terminal member 33 with the coil containing member 34.

In addition, one lead wire 40 of the resistor 39 is led out to the exterior through the groove 41 at the side surface of resistor 39, the other lead wire 53 being electrically connected to one conductor wire 50 inserted into the bore 38.

Figure 2:
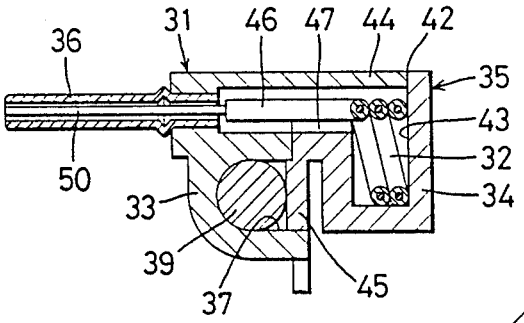
FIG. 2 is a longitudinally sectional side view of the same.
Figure 4:
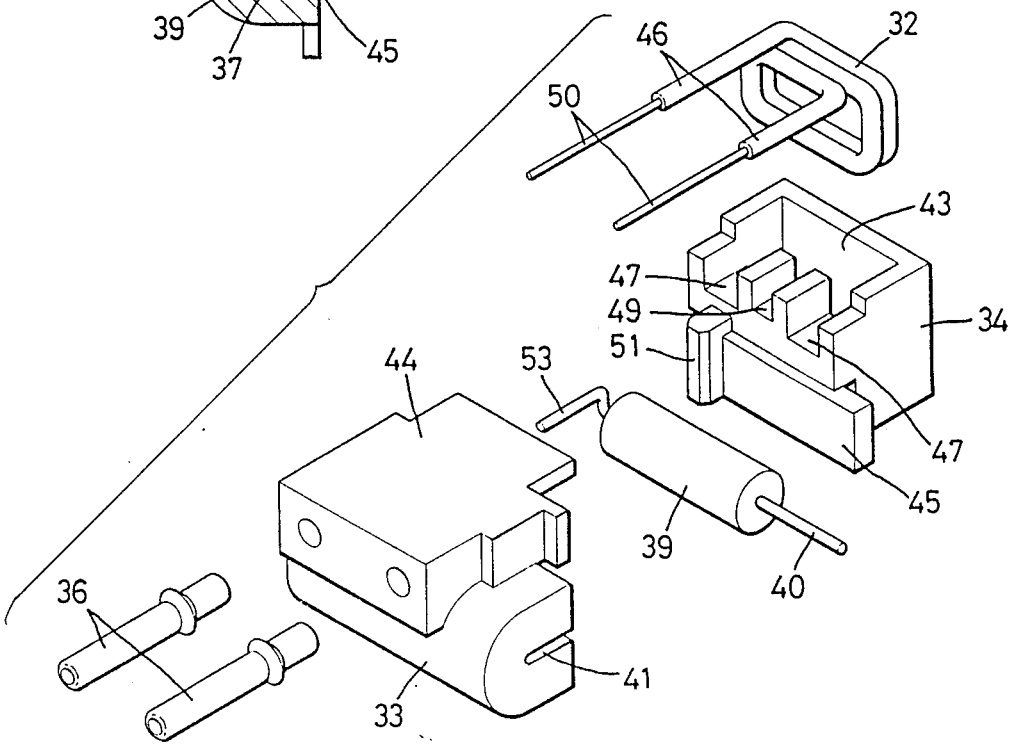
FIG. 4 is a perspective exploded view of the same.
Figure 10:
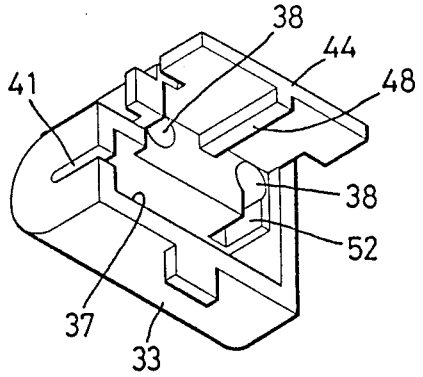
FIG. 10 is a perspective view of the rear of a terminal member at the same.

Therefore, as shown in FIGS. 1 and 2, an antenna device 31 housing the antenna coil 32 within the insulator 35 is completed the antenna coil 32 being formed of the single-covered wire small in diameter and easy to work, whereby the antenna coil 32 of accurate configuration is obtained with ease and contained in the coil containing recess 43 at the coil containing member 34. Hence, there is no fear that the coil 32 is deformed during or after the assembly of the antenna device, and also the antenna device can obtain the insulating property equivalent to the double covered wire.

The cover 44 for the terminal member 33 is press-fitted into the inner periphery of the opening at the coil containing recess 43 to integrally couple the terminal member 33 with the coil containing member 34, thereby facilitating assembly of the antenna device 31, saving the material cost, and reducing the assembly time of the same.

Next, a second embodiment of the antenna device of the invention shown in FIGS. 6 through 11 will be described.

In addition, in the second embodiment, the components the same as those in the first embodiment are designated by the same reference numerals and omitted of explanation, only the different points therebetween are described.

The second embodiment is different from the first embodiment in the structure of the fitting portion 42 for integrally coupling the terminal member 33 with the coil containing member 34 constituting the insulator 35.

In the second embodiment, the cover 44 provided at the terminal member 33 is made larger in width to overlap the upper surface of coil containing member 34, thereby merely closing the upper opening at the coil containing recess 43.

Figure 11:
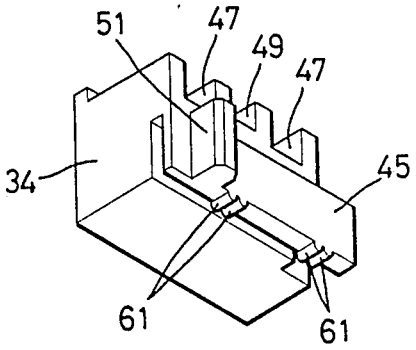
FIG. 11 is a perspective view of the bottom of a coil containing member at the same.
Figure 12:
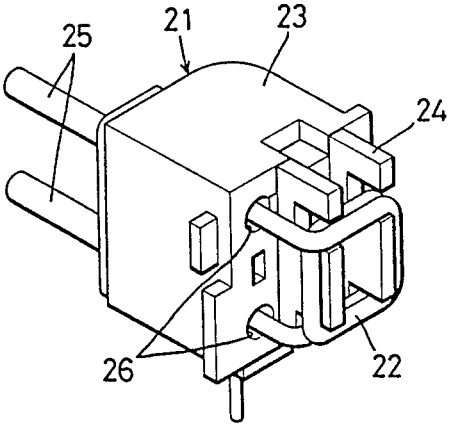
FIG.12 PRIOR ART
FIG. 12 is a perspective view of the conventional antenna device.
Figure 13:
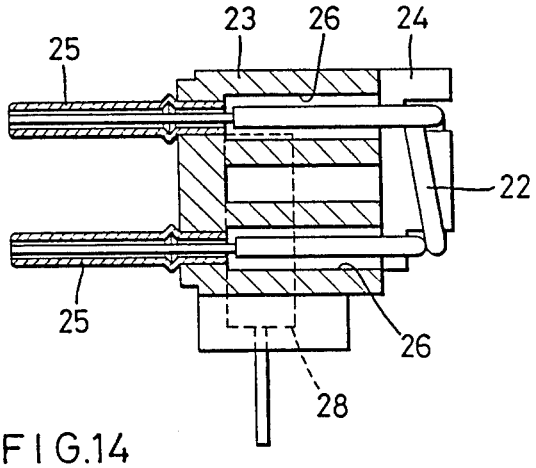
FIG.13 PRIOR ART
FIG. 13 is a longitudinally sectional side view thereof.
Figure 14:
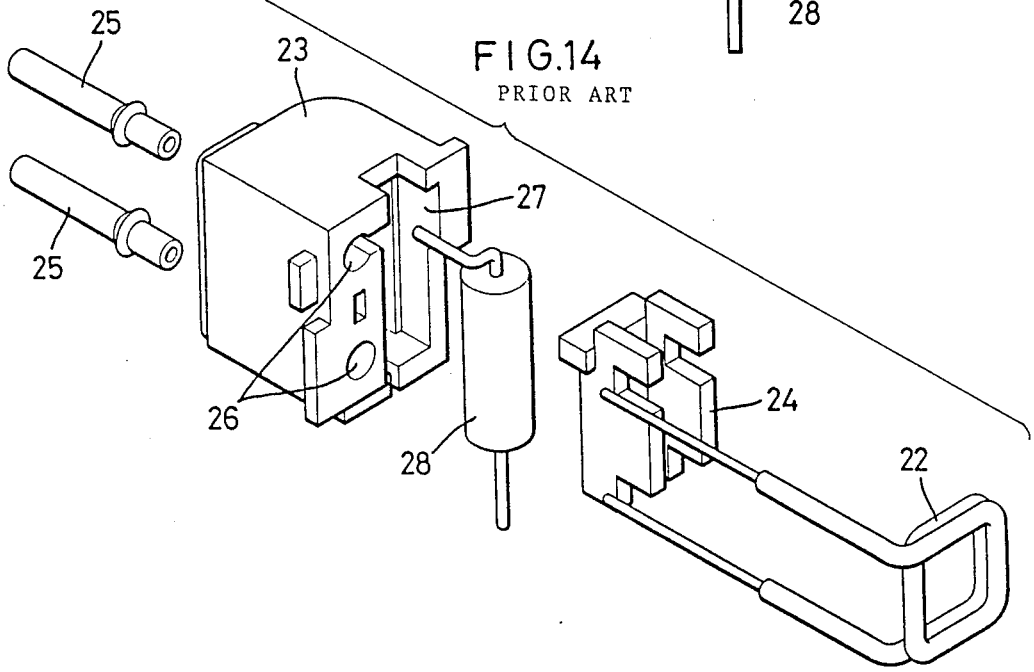
FIG.14 PRIOR ART
FIG. 14 is a perspective exploded view of the same.

Projections 61, as shown in FIG. 11, are formed at both ends of the bottom of lid 45 provided at the coil containing member 34 so that when the lid 45 is fitted into the opening at the resistor containing recess 37, each projection 61 is press-fitted into the opening in a manner of being crushed, thereby forming the fitting portion 42 for integrally coupling the terminal member 33 with the coil containing member 34.

Accordingly, when the antenna device 31 is assembled, the lid 45 is press-fitted into the opening at the resistor containing recess 37, thereby enabling the terminal member 33 and coil containing member 34 to be fixed.

In addition, as other embodiments, the lid 45 of coil containing member 34 is fitted into the resistor containing recess 37 and the bottom surface of the cover 44 abuts against the upper ends of the grooves 47 and 49 at the coil containing member 34, whereby the lid 45 abutting against the bottom surface of resistor containing recess 37 and the cover 44 abutting against the upper end of each groove thus integrally vertically couple the terminal member 33 with the coil containing member 34.

Although several embodiments have been described, they are merely exemplary of the invention and not to be constructed as limiting, the invention being defined solely by the appended claims.

We claim:

1. An antenna device for introducing an antenna output to a UHF tuner of a television receiver, comprising:

an insulator body having an open top coil receiving recess therein partly defined by a forwardly facing side wall, said side wall having a top edge having there side by side forwardly extending grooves therein;

an antenna coil formed of a single covered wire and fitted into said recess and having two forwardly extending parallel lead portions extending therefrom, said lead portions being fitted into two of said grooves;

a terminal member having a pair of parallel antenna terminals for receiving said parallel lead portions therein and having a cover integral with said terminal member and extending over the open top of said coil receiving recess when said terminal member is abutted against said insulator body with said lead portions in said antenna terminals, said cover having an elongated projection on the under surface thereof fitted into the remaining one of said grooves, said terminal member further having a rearwardly open resistor containing recess for containing a generally cylindrical shaped resistor and having the length dimension of said resistor containing recess extending transverse to said lead terminals and spaced from and crossing said lead terminals;

said insulator body having a resistor containing recess cover thereon fitting over said laterally open resistor containing recess when said terminal member is abutted against said insulator body.

2. An antenna device as claimed in claim 1 in which said cover is press fitted into the open top of said coil receiving recess for integrally coupling said insulator body and said terminal member.

3. An antenna device as claimed in claim 1 in which said resistor containing recess cover is press fitted into the rearwardly open resistor containing recess for integrally coupling said insulator body and said terminal member.

4. An antenna device as set forth in claim 1, wherein said insulator body and terminal member are integrally coupled with each other with said resistor containing recess cover provided on said insulator body fitted into the opening of said resistor containing recess provided in said terminal member and the lower surface of said coil containing recess cover abuts against the upper edge of each groove in said insulator body so that the bottom surface of said resistor containing recess cover and the lower surface of said coil containing recess cover abut against each of said grooves and are vertically fitted to integrally couple said insulator body with said terminal member.

* * * * *